US008219012B2

(12) United States Patent
Embry et al.

(10) Patent No.: US 8,219,012 B2
(45) Date of Patent: Jul. 10, 2012

(54) RETRACTION MECHANISM FOR A TONER IMAGE TRANSFER APPARATUS

(75) Inventors: Kerry Leland Embry, Midway, KY (US); Alexander J Geyling, Lexington, KY (US); Michael David Maul, Lexington, KY (US); Stacy Marie Pargett, Richmond, KY (US); Harald Portig, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 1352 days.

(21) Appl. No.: 11/669,206

(22) Filed: Jan. 31, 2007

(65) Prior Publication Data

US 2008/0179013 A1 Jul. 31, 2008

(51) Int. Cl.
*G03G 15/16* (2006.01)

(52) U.S. Cl. ..... 399/313; 399/121

(58) Field of Classification Search ..... 399/313, 399/121, 124, 126, 297
See application file for complete search history.

(56) References Cited

U.S. PATENT DOCUMENTS

| | | | | |
|---|---|---|---|---|
| 5,001,809 | A * | 3/1991 | Kim et al. | |
| 5,596,395 | A * | 1/1997 | Sawamura et al. | |
| 5,943,540 | A * | 8/1999 | Okamoto et al. | |
| 6,253,046 | B1 | 6/2001 | Horrall et al. | |
| 6,585,368 | B1 * | 7/2003 | Park | |
| 6,681,094 | B2 | 1/2004 | Horrall et al. | |
| 2004/0013452 | A1 * | 1/2004 | Choi | 399/313 |
| 2007/0071529 | A1 * | 3/2007 | Lee et al. | |
| 2008/0181686 | A1 | 7/2008 | Geyling et al. | |

FOREIGN PATENT DOCUMENTS

| | | | |
|---|---|---|---|
| JP | 08146792 | A * | 6/1996 |
| JP | 2004286857 | A * | 10/2004 |

* cited by examiner

*Primary Examiner* — David Porta
*Assistant Examiner* — Milton Gonzalez

(57) ABSTRACT

A toner image transfer apparatus in a printer is provided. The toner image transfer apparatus comprises a transfer belt structure, a rotatable transfer rod and a transfer roll retraction mechanism. The transfer belt structure comprises a driven toner image transfer belt and a rotatable backup roll engaging an inner surface of the transfer belt. The rotatable transfer roll is adapted to define a nip with the belt and backup roll. The transfer roll retraction mechanism comprises motion transfer structure coupled to the transfer roll and drive apparatus associated with the motion transfer structure.

21 Claims, 11 Drawing Sheets

RETRACTION MECHANISM FOR A TONER IMAGE TRANSFER APPARATUS

This application is related to U.S. patent application Ser. No. 11/668,635, entitled "FUSER ASSEMBLY INCLUDING A NIP RELEASE MECHANISM," which is filed concurrently herewith and hereby incorporated by reference herein.

FIELD OF THE INVENTION

The present invention relates to a retraction mechanism for a toner image transfer apparatus, wherein the retraction mechanism functions without a sensor feedback loop.

BACKGROUND OF THE INVENTION

In a known type of color electrophotographic (EP) printer, four stations associated with four colors, yellow, magenta, cyan, and black, are provided. Each station includes a laser printhead that is scanned to provide a latent image on the charged surface of a photoconductive (PC) drum. The latent image on each drum is developed with the appropriate color toner and transferred onto an intermediate transfer member (ITM) belt. A composite layer image is accumulated on the belt by passing each of the four color stations in turn. The composite layer image is then transferred to a substrate at a second transfer station. The second transfer station may comprise a transfer roll and a backup roll engaging the inside of the ITM belt, such as disclosed in U.S. Pat. No. 6,681,094, the disclosure of which is incorporated herein by reference.

For certain toner materials, such as a chemically process toner material, a high compressive load, e.g., 36 g/mm of roll contact length, is required to ensure proper toner image transfer from the ITM belt to a substrate.

Traditionally, the transfer roll may comprise an outer compliant layer. Such a layer can be deformed permanently, i.e., compression set, if left inactive and under a high compressive load, e.g., 36 g/mm of roll contact length, for prolonged periods of time. The deformation can lead to print defects.

It is known to provide a transfer roll retraction mechanism to release the transfer nip load when a printer is inactive. However, it is believed that such retraction mechanisms require a feedback system comprising one or more sensors in combination with a controller to control the position of the retraction mechanism and, hence, the transfer roll relative to the ITM belt and backup roll.

If would be desirable to have a transfer roll retraction mechanism not requiring a sensor feedback system so as to reduce the cost of the mechanism.

SUMMARY OF THE INVENTION

In accordance with a first aspect of the present invention, a toner image transfer apparatus in a printer is provided. The toner image transfer apparatus comprises a transfer belt structure, a rotatable transfer roll and a transfer roll retraction mechanism. The transfer bell structure comprises a driven toner image transfer belt and a rotatable backup roll engaging an inner surface of the transfer belt. The rotatable transfer roll is adapted to define a nip with the belt and backup roll. The transfer roll retraction mechanism comprises motion transfer structure coupled to the transfer roll and drive apparatus associated with the motion transfer structure. The drive apparatus includes a drive motor, which is preferably shared with another mechanism or structure in the printer separate from the motion transfer structure of the transfer roll retraction mechanism. The motion transfer structure applies a sufficient force to the transfer roll to achieve a desired nip load in response to the drive motor rotating in a first direction and the motion transfer structure decreases the force to the transfer roll to decrease the load at the nip in response to the drive motor rotating in a second direction. The motion transfer structure preferably applies and decreases the force without the use of a sensor feedback loop.

The drive apparatus further comprises a gear train associated with the drive motor.

The motion transfer structure may comprise nip-loading structure adapted to engage the transfer roll; at least one spring for engaging the nip-loading structure; a swing arm assembly adapted to pivot to a first position in response to the drive motor rotating in the first direction and to a second position in response to the drive motor rotating in the second direction; and a cam assembly including at least one cam element for positioning the nip-loading structure to apply the sufficient force to the transfer roll in response to the drive motor rotating in the first direction and for positioning the nip-loading structure to decrease the force applied to the transfer roll in response to the drive motor rotating in the second direction.

The swing arm assembly may comprise a mounting plate, first, second and third gears mounted to the mounting plate, and a drag generating element provided between the mounting plate and at least one of the first, second and third gears. The first gear is adapted to engage with a gear forming part of the drive apparatus gear train. The swing arm assembly may pivot about an axis of the first gear. The drag generating element functions to transfer a force via friction from the one gear to the mounting plate in response to rotation of the one gear. The force from the first gear causes the mounting plate to pivot in response to movement of the first gear. The second and third gears are mounted to the mounting plate and in engagement with the first gear for rotation with the first gear.

The cam assembly may comprise a sector gear comprising a first segment including teeth and a second segment devoid of teeth; a cam shaft coupled to the sector gear for rotation with the sector gear; and a first cam element coupled to the cam shaft for rotation with the cam shaft. The second gear causes the sector gear to rotate to effect movement of the cam shaft to cause the first cam element to position the nip-loading structure to apply the sufficient force to the transfer roll and the third gear causing the sector gear to rotate to cause the first cam element to position the nip-loading structure to decrease the force applied to the transfer roll.

The cam assembly may further comprise a second cam element.

The nip-loading structure may comprise first and second levers. The first lever is pivotably coupled at a first end to a frame and comprises an intermediate portion to which the transfer roll is coupled and a second end for engaging the first cam element. The second lever is pivotably coupled at a first end to the frame and comprises an intermediate portion to which the transfer roll is coupled and a second end for engaging the second cam element.

The at least one spring comprises first and second springs. The first spring extends between the frame and the first lever and the second spring extends between the frame and the second lever.

The transfer belt structure may further comprise a catch associated with the backup roll so as to rotate with the backup roll. The catch is adapted to restrain the mounting plate when the backup roll is rotated in a forward direction.

The drag generating element may comprise a damping grease.

In accordance with a second aspect of the present invention, a toner image transfer apparatus in a printer is provided. The toner image transfer apparatus composes transfer belt structure, a rotatable transfer roll and a transfer roll retraction mechanism. The transfer belt structure comprises a driven toner image transfer belt and a rotatable backup roll engaging an inner surface of the transfer belt. The rotatable transfer roll is adapted to define a nip with the belt and backup roll. The transfer roll retraction mechanism comprises motion transfer structure coupled to the transfer roll and drive apparatus associated with the motion transfer structure and including a drive motor. The motion transfer structure applies a sufficient force to the transfer roll to achieve a desired nip load in response to the drive motor rotating in a first direction and the motion transfer structure decreases the force to the transfer roll to decrease the load at the nip in response to the drive motor rotating in a second direction. The motion transfer structure applies and decreases the force without the use of a sensor feedback loop.

In accordance with a third aspect of the present invention, a transfer belt structure is provided comprising a driven toner image transfer belt, a rotatable element engaging a surface of the transfer belt and a catch. The catch is associated with the rotatable element, capable of rotating with the rotatable element and adapted to restrain a mounting plate when moved to a locking position in response to the rotatable element rotating in a forward direction. The rotatable element rotates in a forward direction in response to the transfer belt moving in a forward direction.

The transfer belt causes the rotatable element to rotate in a reverse direction when the belt moves in a reverse direction. The rotatable element causes the catch to move from the locking position to a released position when the rotatable element rotates in the reverse direction.

The rotatable element may comprise a rotatable backup roll engaging a surface of the transfer belt. The backup roll is adapted to define a nip with the belt and a rotatable transfer roll.

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
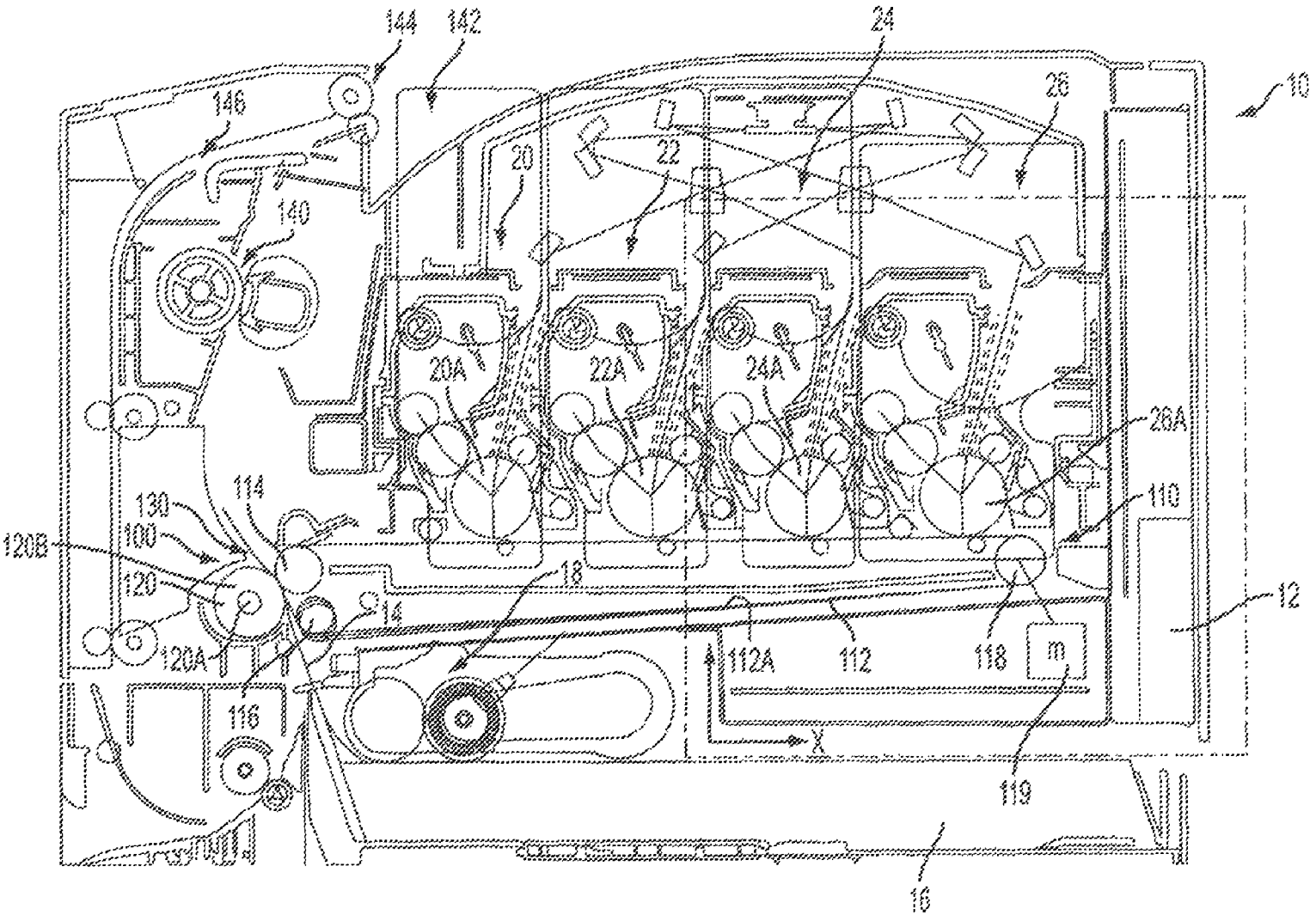
FIG. 1 is a schematic view of a printer including a toner image transfer apparatus constructed in accordance with the present invention.

FIG. 1 depicts a representative electrophotographic image forming apparatus, such as a color laser printer, which is indicated generally by the numeral 10. An image to be printed may be electronically transmitted to a print engine controller or processor 12 by an external device (not shown) or may comprise an image stored in a memory of the processor 12. The processor 12 includes system memory, one or more processors, and other logic necessary to control the functions of electrophotographic imaging.

In performing a printing operation, the processor 12 initiates an imaging operation where a top substrate 14 of a stack of media is picked from a media fray 16 by a pick mechanism 18 and is delivered to a toner image transfer apparatus 100, where a single or composite layer toner image is transferred to the substrate 14. The toner image transfer apparatus 100 comprises an intermediate transfer member (ITM) belt structure 110, a transfer roll 120 and a transfer roll retraction mechanism 200, see FIGS. 1 and 2. The ITM belt structure 110 comprises an endless ITM belt 112, a backup roll 114, a tension roll 118 and a drive roll 118 driven by a motor 119, see FIG. 1. The backup and tension rolls 114, 116 are driven by frictional engagement with an inner surface 112A of the belt 112. The drive roll 118 causes the belt 112 to rotate. The transfer roll 120 defines a nip 130 with the ITM belt 112 and the backup roll 114 for receiving a substrate 14. The transfer roll 120 is driven via frictional engagement with the belt 112. As will be discussed further below, the transfer roll retraction mechanism 200 causes, during a printing operation, the transfer roll 120 to engage the belt 112 and the backup roll 114 with a sufficient force/roll contact length, e.g., 36 g/mm of roll contact length, to allow a single or composite layer toner image, formed, for example, from a chemically processed toner material, to be properly transferred from the ITM belt 112 to the substrate 14 passing through the nip 130. As discussed in U.S. Pat. No. 6,681,094, the disclosure of which is incorporated herein by reference, a voltage is applied to the transfer roll 120 opposite in polarity to the charge on the toner so as to allow the toner image to be transferred from the ITM belt 112 to the substrate 14.

The printer 10 further comprises first, second, third and fourth image forming stations 20, 22, 24 and 26, each of which is capable of generating and applying a toner image layer to the ITM belt 112, see FIG. 1. The first image forming station 20 includes a photoconductive drum 20A that delivers yellow toner to the ITM belt 112 in a pattern corresponding to a yellow image layer being printed. The second image forming station 22 includes a photoconductive drum 22A that delivers cyan toner to the ITM belt 112 in a pattern corresponding to the cyan image layer being printed. The third image forming station 24 includes a photoconductive drum 24A that delivers magenta toner to the ITM belt 112 in a pattern corresponding to the magenta image layer being printed. The fourth image forming station 26 includes a photoconductive drum 26A that delivers black toner to the ITM belt 112 in a pattern corresponding to the black image layer being printed. As noted above, a single or composite layer toner image is transferred from the ITM belt 112 to a substrate 14 in the nip 130 of the toner image transfer apparatus 100.

From the toner image transfer apparatus 100, the substrate 14 is received by a fuser mechanism 140, which applies heat and pressure to the toned substrate 14 so as to promote adhesion of the toner thereto. A pair of exit rolls 144 is provided downstream from the fuser mechanism 140. The exit rolls 144 receive the substrate 14 from the fuser mechanism 140 and transport the substrate 14 from the fuser mechanism 140 into an exit tray 142 or a duplexing path 146 for performing a duplex printing operation on a second surface of the substrate 14. The processor 12 regulates the speed of the ITM belt 112, substrate pick timing and the timing of the image forming stations 20, 22, 24, 26 to effect proper registration and alignment of the different image layers to the substrate 14.

In the illustrated embodiment, the backup roll 114 is formed from a metal such as aluminum, see FIG. 1. The transfer roll 120 comprises a metal shaft 120A and a compliant outer layer 120B formed, for example, from a polymeric foam material. As noted above, the transfer roll retraction mechanism 200 causes, during a printing operation, the transfer roll 120 to engage the belt 112 and the backup roll 114 with a sufficient force/roll contact length, e.g., 36 g/mm of roll contact length, to allow a single or composite layer toner image to be properly transferred from the ITM belt 112 to the substrate 14 passing through the nip 130. When the force/roll contact length is approximately 36 g/mm of roll contact length or greater, the outer compliant layer 120B of the transfer roll 120 can be deformed permanently, i.e., compression set, if left inactive and under such a high force/roll contact length for an extended length of time. As will be discussed further below, the transfer roll retraction mechanism 200 moves the transfer roll 120 away from the belt 112 and the backup roll 114 so as to reduce the force/roll contact length in the nip 130 when the printer 10 is off, in a power saver mode, in a standby mode or otherwise inactive for an extended period of time.

Figure 2:
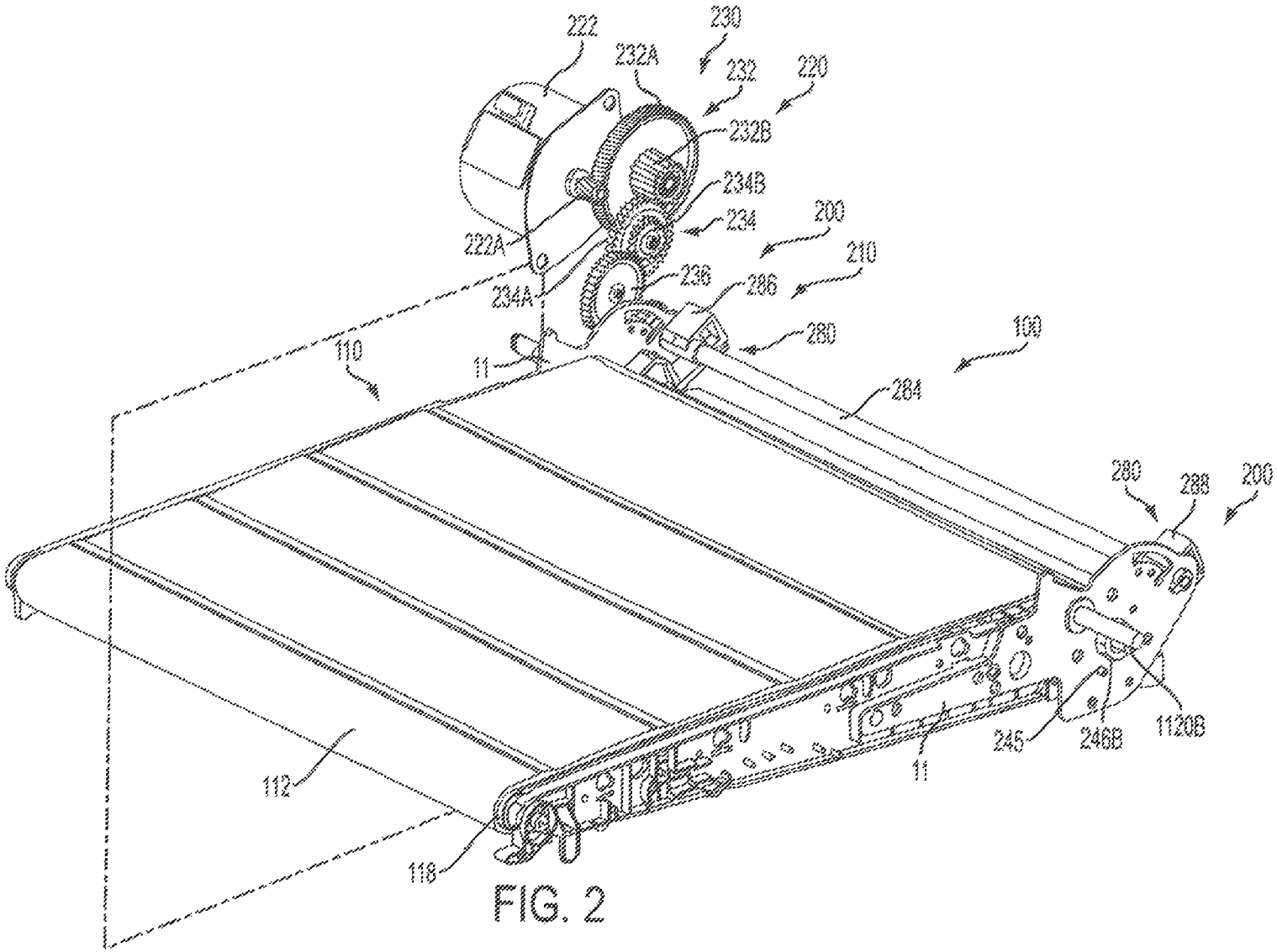
FIG. 2 is a perspective view of the toner image transfer apparatus of FIG. 1.

The transfer roll retraction mechanism 200 comprises motion transfer structure 210 coupled to the transfer roll 120 and drive apparatus 220, see FIG. 2. In the illustrated embodiment, the drive apparatus 220 comprises a drive motor 222 and a speed reduction gear train 230. In the illustrated embodiment, the drive motor 222 is shared with another mechanism or structure in the printer 10, which comprises the fuser mechanism 140. By sharing the drive motor 222 with another mechanism in the printer 10, the overall cost of the printer 10 is believed to be reduced.

The drive motor 222 includes a pinion gear 222A, see FIG. 2. The gear train 230 comprises a first compound gear 232, a second compound gear 234, and an idler gear 236. A first portion 232A of the first compound gear 232 engages the pinion gear 222A while a second portion 232B of the first compound gear 232 engages a first portion 234A of the second compound gear 234. A second portion 234B of the second compound gear 234 engages the idler gear 236. The idler gear 236 engages a first gear 274, to be described below, see FIG. 2A. The drive motor 222 is controlled by the processor 12, which controls the rotational direction and speed of the motor 222. In the illustrated embodiment, the first compound gear 232 forms part of a gear train for the fuser mechanism 140, see U.S. patent application Ser. No. 11/668,635, entitled "FUSER ASSEMBLY INCLUDING A NIP RELEASE MECHANISM," which is filed concurrently herewith and previously incorporated herein by reference.

The motion transfer structure 210 comprises nip-loading structure 240 coupled to the transfer roll 120, first and second springs 260 and 262 for engaging the nip-loading structure 240, a swing arm assembly 270, and a cam assembly 280, see FIGS. 2-10 and 2A.

Figure 2B:
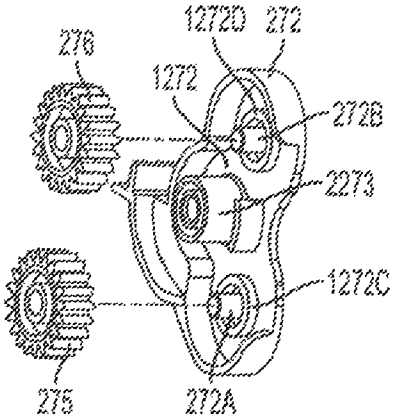
FIG. 2B is an exploded view of the mounting plate and second and third gears of a swing arm assembly of the toner image transfer apparatus of FIG. 1.
Figure 2C:
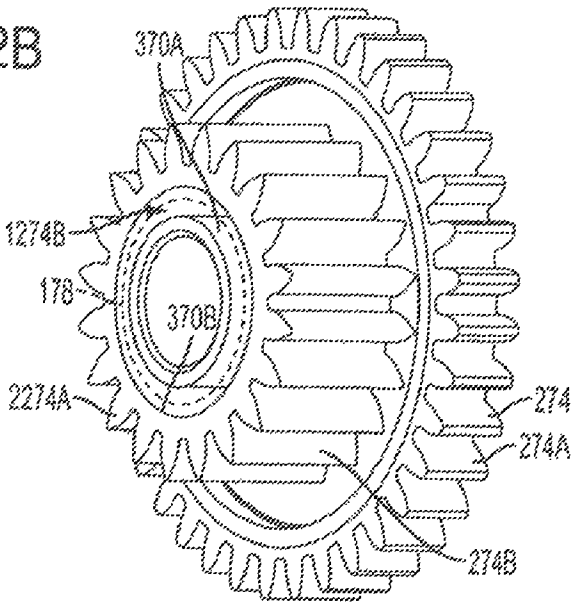
FIG. 2C is a perspective view of the first gear of the swing arm assembly of the toner image transfer apparatus of FIG. 1.
Figure 2A:
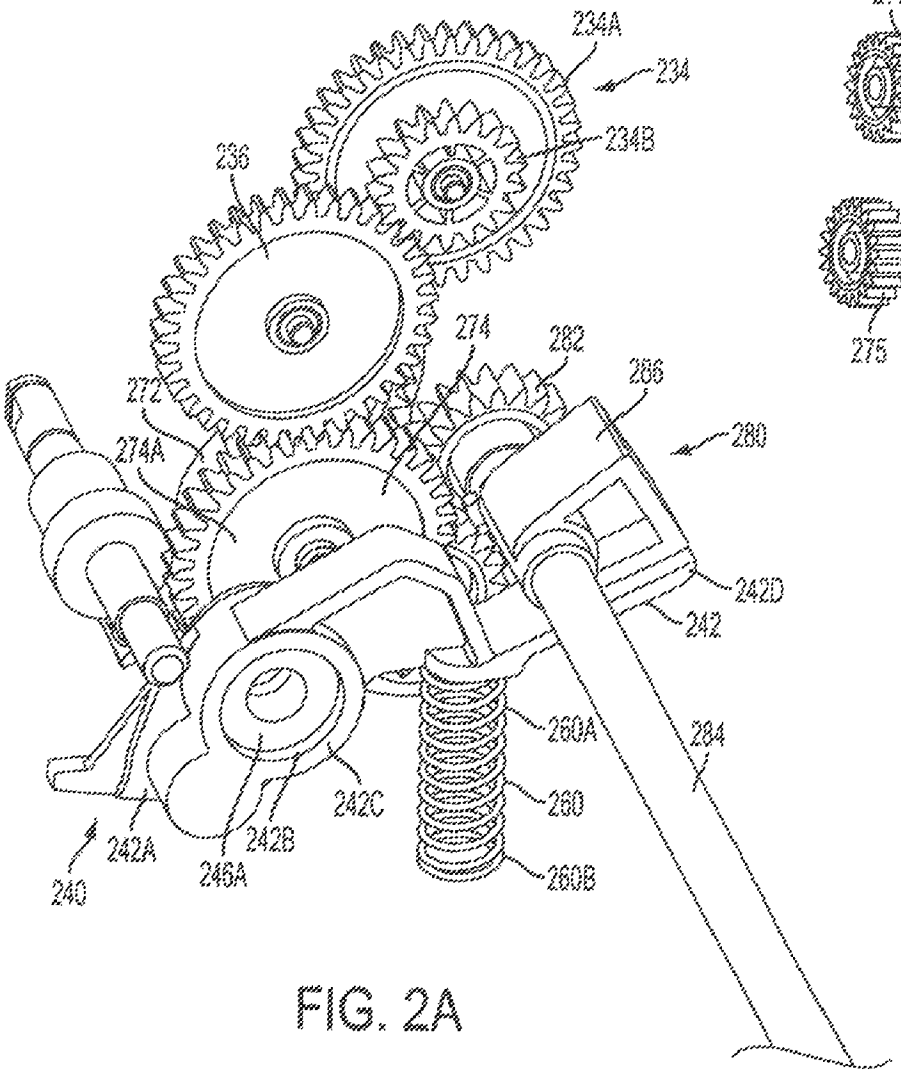
FIG. 2A is a perspective view of a transfer roll retraction mechanism of the toner image transfer apparatus of FIG. 1 with the mounting plate removed.
Figure 3:
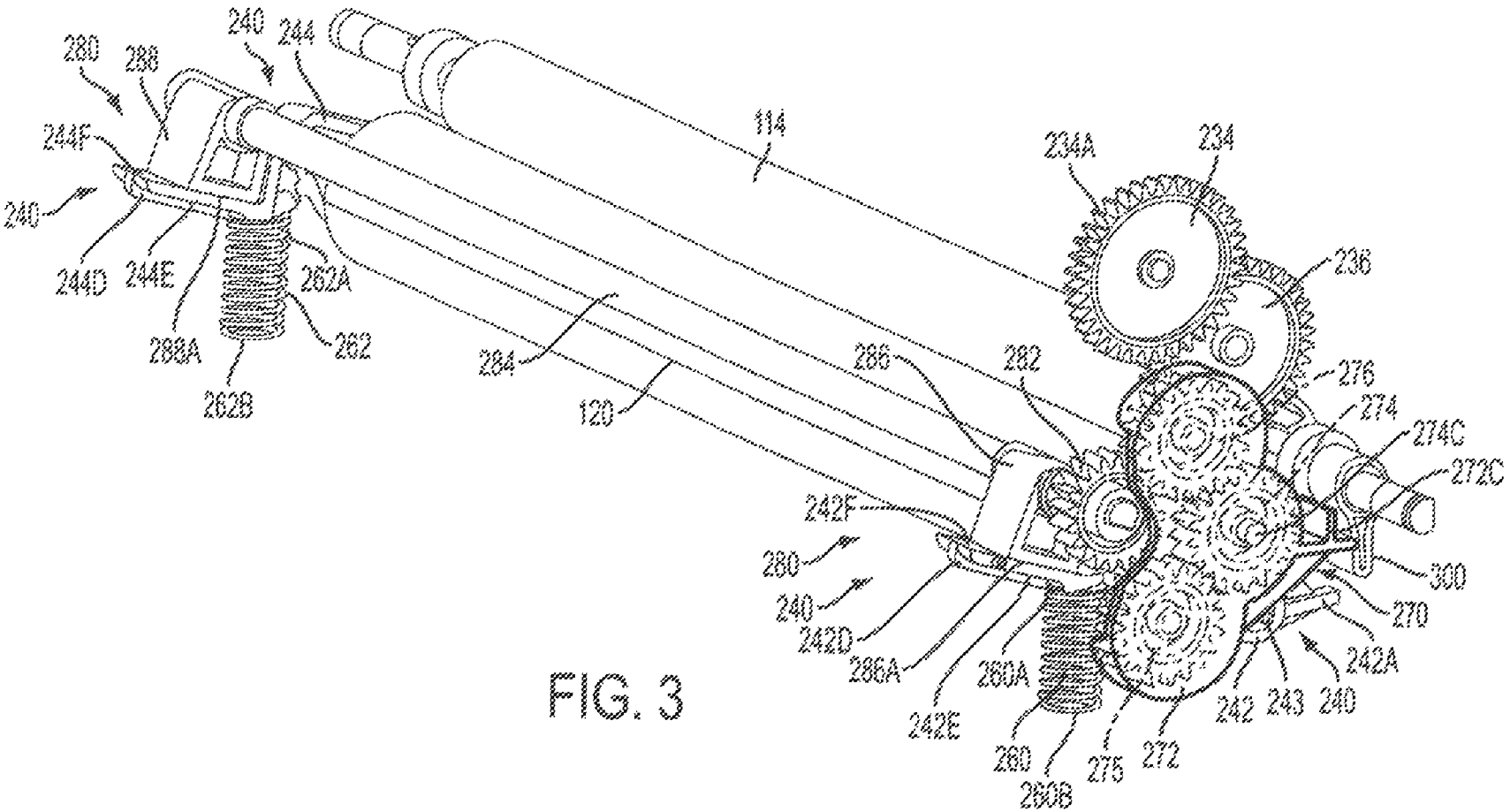
FIG. 3 is a perspective view of the toner image transfer apparatus of FIG. 1 with a drive motor, a first compound gear and an ITM belt removed and illustrating the swing arm assembly in its second end-most position.

The nip-loading structure 240 comprises first and second levers 242 and 244, see FIGS. 2A and 3. The first lever 242 is pivotably coupled at a first end 242A to a frame 11 forming part of the ITM belt structure 110 via a mounting pin 243, see FIGS. 2-4. The ITM belt structure 110 is releasably mounted within a main frame of the printer 10. A first bearing 246A is received in a bore 242B provided in an intermediate portion 242C of the first lever 242, see FIG. 2A. A first end (not shown) of a shaft of the transfer roll 120 is received in the bearing 246A such that the transfer roll 120 is coupled to the first lever 242. The first lever 242 further comprises a second end 242D opposite the first end 242A.

The second lever 244 is formed as a mirror image of the first lever 242. The second lever 244 is pivotably coupled at a first end to the frame 11 via a mounting pin 245, see FIG. 2. A second bearing (not shown) is received in a bore (not shown) provided in an intermediate portion of the second lever 244. A second end 1120B of the shaft of the transfer roll 120 is received in the second bearing such that the transfer roll 120 is coupled to the second lever 244. The second lever 244 further comprises a second end 244D opposite the first end 244A, see FIG. 3. The first and second bearings in the first and second levers 242, 244 allow the transfer roll 120 to rotate relative to the first and second levers 242 and 244. The transfer roll 120 also moves with the first and second levers 242 and 244 as the levers pivot about the first and second mounting pins 243 and 245.

Figure 10:
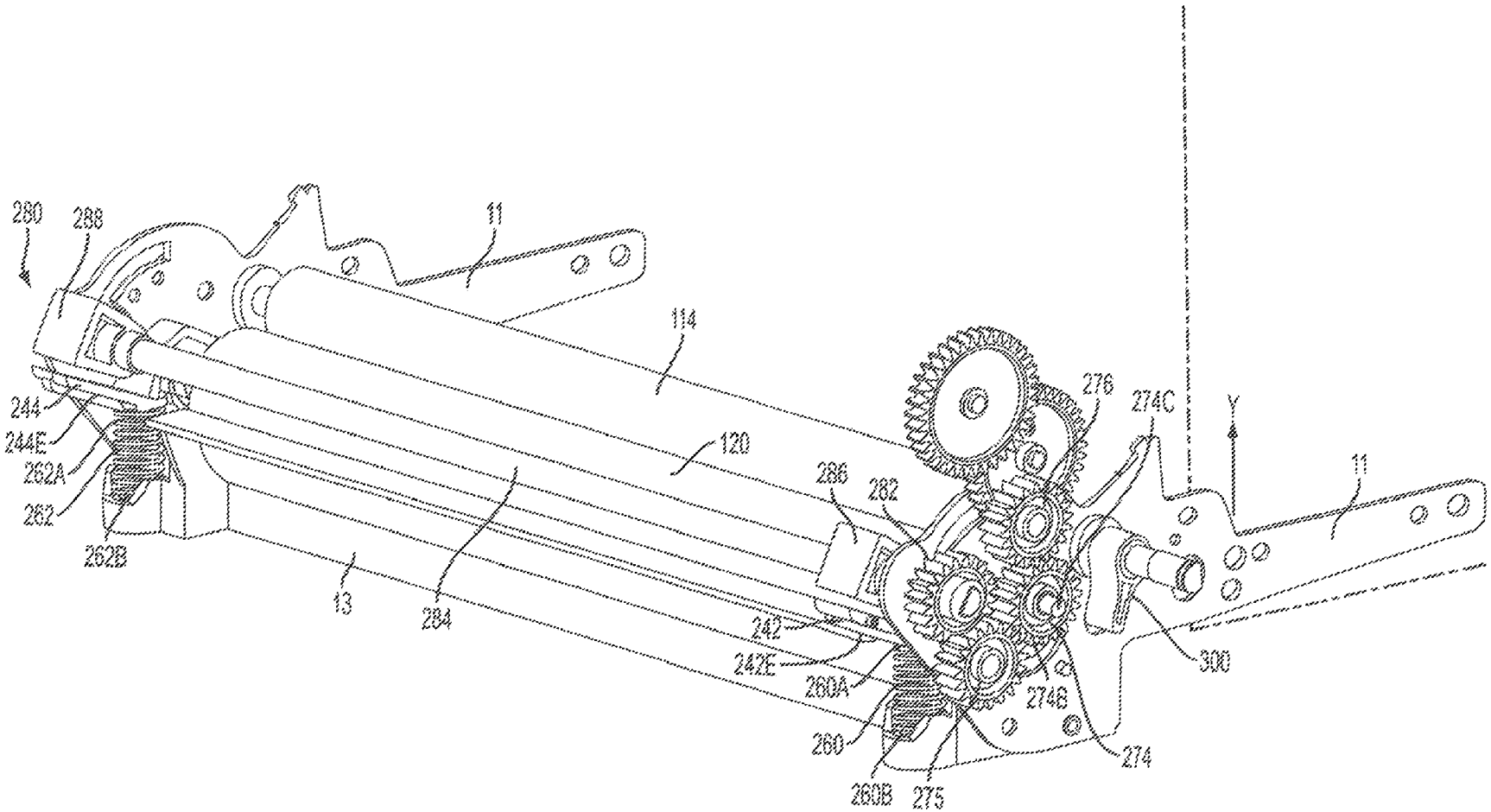
FIG. 10 is a perspective view of the toner image transfer apparatus of FIG. 1 with the drive motor, the first compound gear and the mounting plate removed.

The first spring 260 comprises a compression spring having a first end 260A engaging a first side 242E of the first lever 242 and a second end 260B engaging a paper deflector 13, which is fixed to the frame 11, see FIGS. 3 and 10. The second spring 262 comprises a compression spring having a first end 262A engaging a first side 244E of the second lever 244 and a second end 262B engaging the paper deflector 13.

The swing arm assembly 270 comprises a mounting plate 272, first, second and third gears 274-276 mounted to the mounting plate 272 and a drag generating element, to be discussed below. The mounting plate 272 is not illustrated in FIG. 10. The first gear 274 comprises a compound gear having a first portion 274A in engagement with the idler gear 236 of the drive apparatus gear train 230, see FIGS. 2A and 2C. The second and third gears 275 and 276 are always in engagement with a second portion 274B of the first gear 274, see FIG. 10. The first gear 274 is mounted to the plate 272 via a shaft 274C so as to rotate about the shaft 274C and relative to the mounting plate 272, see FIGS. 3 and 10. The second and third gears 275 and 276 are mounted respectively to shafts 272A and 272B formed integral with the mounting plate 272 so as to rotate about the shafts 272A and 272B and relative to the mounting plate 272, see FIG. 2B. The mounting plate 272 is rotatably coupled to the shaft 274C so as to allow the swing arm assembly 270 to pivot about the shaft 274C.

Figure 6:
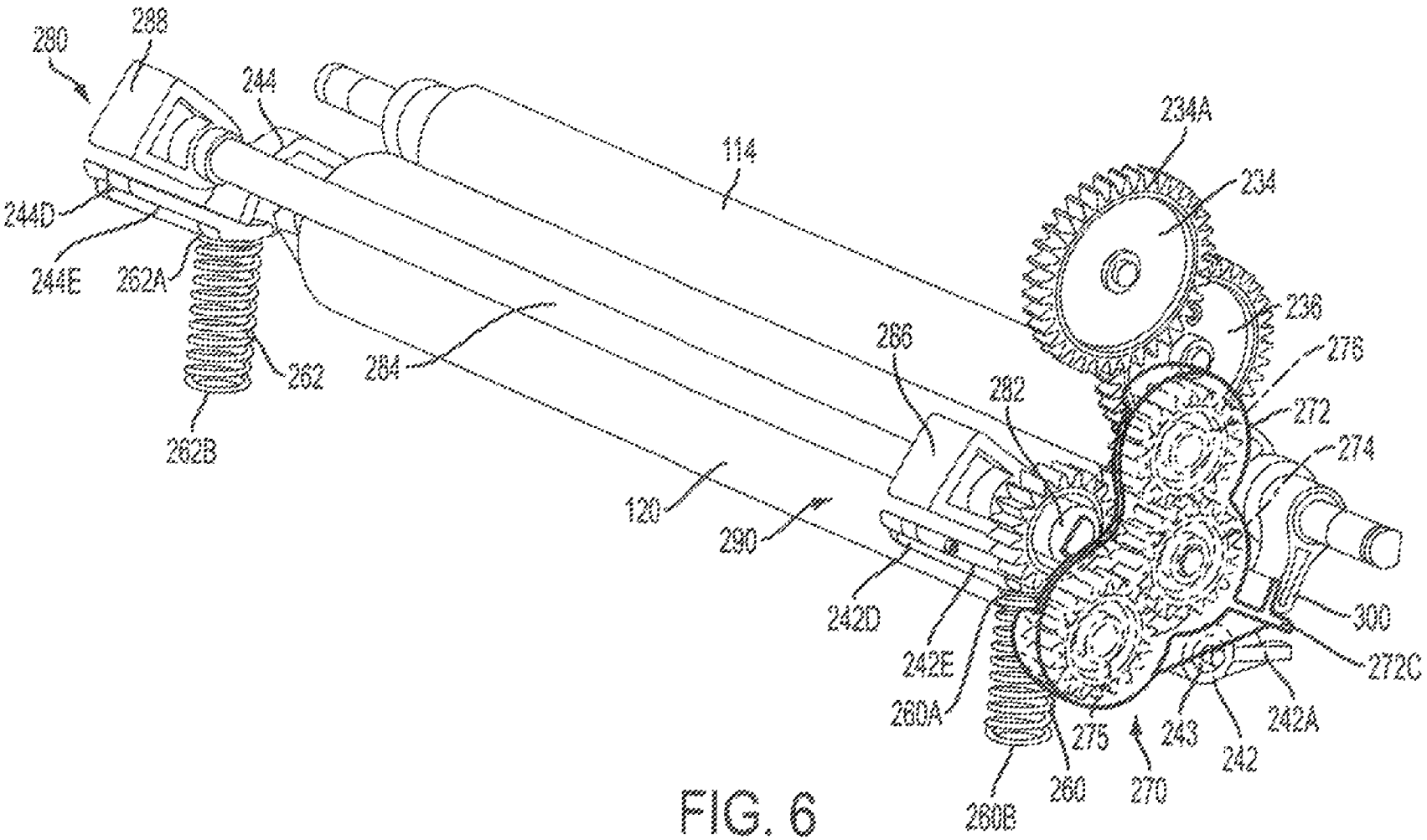
FIG. 6 is a perspective view of the toner image transfer apparatus of FIG. 1 with the drive motor, the first compound gear and the ITM belt removed and illustrating the swing arm assembly in its first end-most position.
Figure 7:
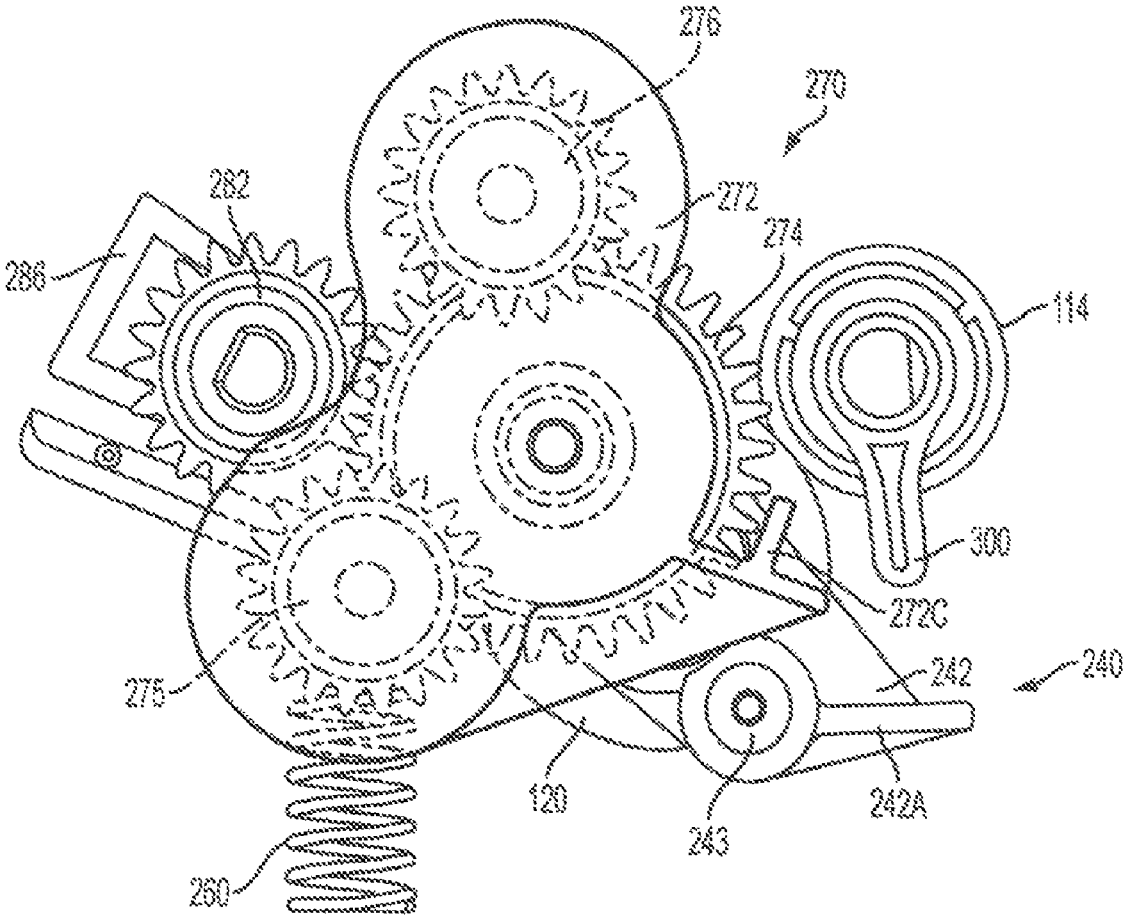
FIG. 7 is a side view of the swing arm assembly in its first end-most position and with the lever rotated to its released position.
Figure 8:
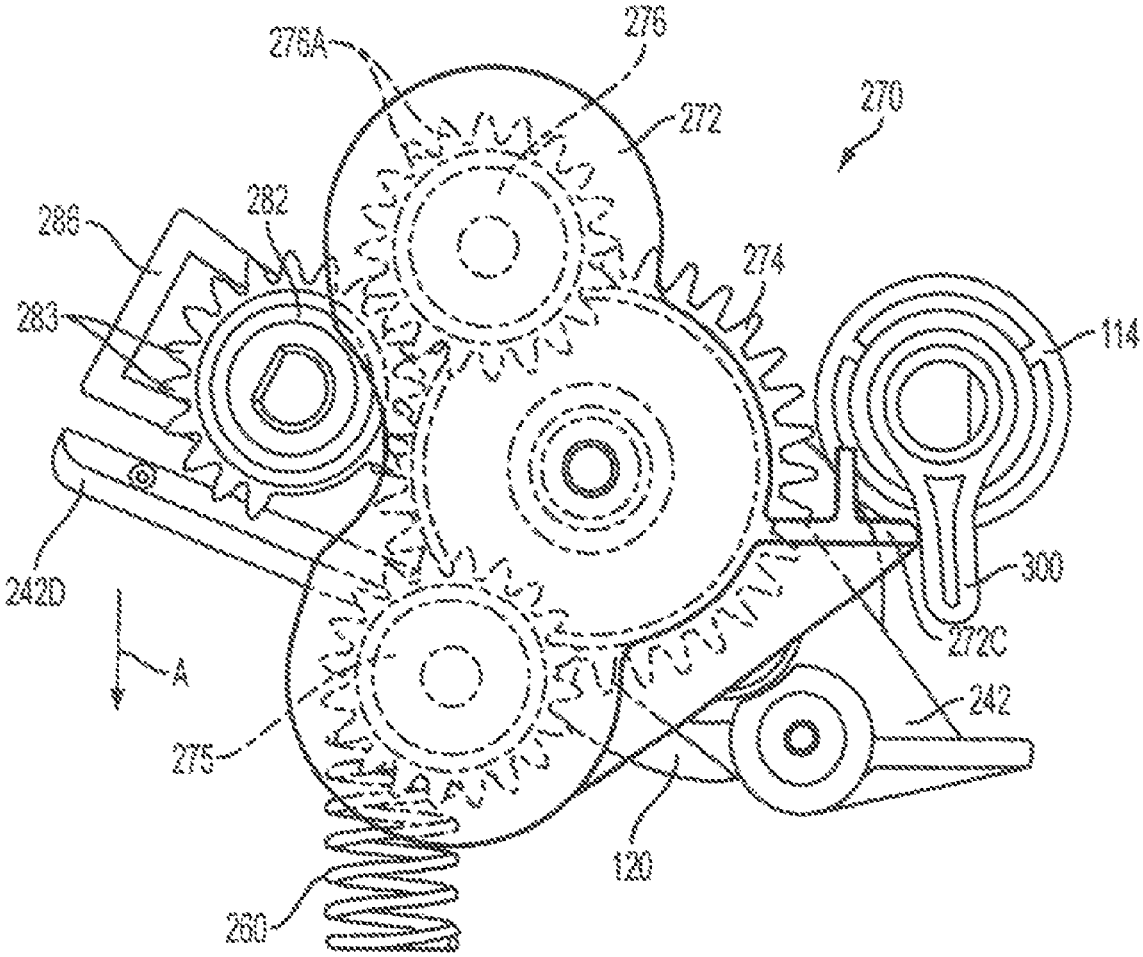
FIG. 8 is a side view of the swing arm assembly in its second end-most position.
Figure 9:
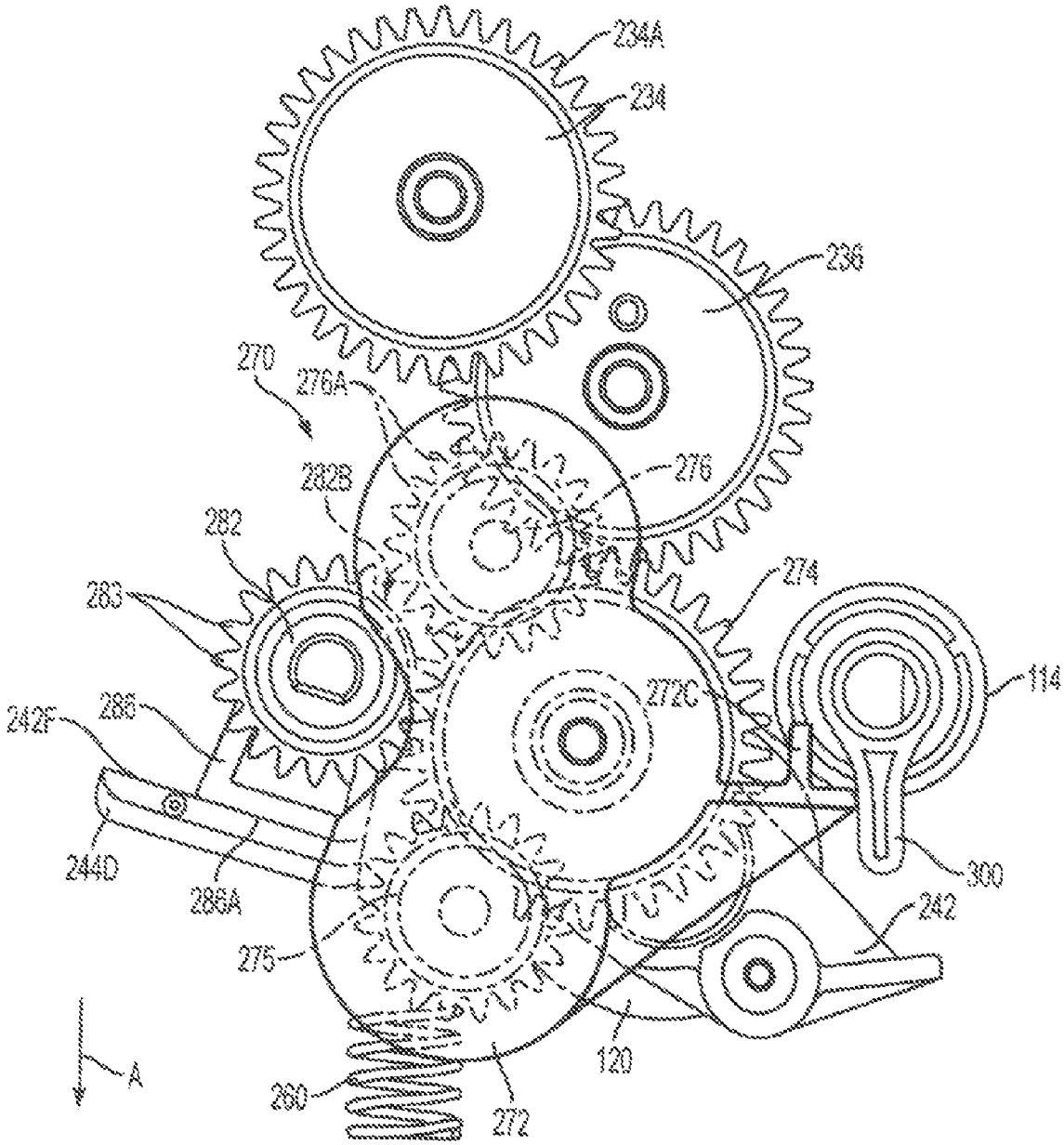
FIG. 9 is a side view of the swing arm assembly in its second end-most position with the sector gear rotated counterclockwise from its position shown in FIG. 8.

The swing arm assembly 270 pivots back and forth about the second shaft 274C between a first end-most position, illustrated in FIGS. 4-7, and a second end-most position, illustrated in FIGS. 3, 8 and 9. The first portion 274A of the first gear 274 is always in engagement with the idler gear 236, see FIG. 2A. Further, the second and third gears 275 and 276 are always in engagement with the second portion 274B of the first gear 274, see FIGS. 2C, 4 and 10. Hence, the first gear 274 engages the idler gear 236 when the swing arm assembly 270 is in its first end-most position as well as when it is in its second end-most position. Likewise, the second and third gears 275 and 276 engage the first gear 274 when the swing arm assembly 270 is in its first end-most position as well as when it is in its second end-most position. In the illustrated embodiment, the swing arm assembly 276 moves through an angle of about 19.5 degrees when moving from its first end-most position to its second end-most position and vice versa. It is contemplated that the amount of angular movement of the swing arm assembly 270 may be varied from 19.5 degrees. As noted above, the first, second and third gears 274-276 rotate relative to the mounting plate 272. In addition, the first, second and third gears 274-276 also pivot with the mounting plate 272 as the swing arm assembly 270 pivots back and forth about the second shaft 274C.

In the illustrated embodiment, the drag generating element comprises a damping grease 178, shown only in FIG. 2C, positioned within a recess 1274B defined by first and second walls 370A and 370B in the second portion 274B of the first gear 274. A cylindrical member 2273 forming an integral part of the mounting plate 272 is received in the recess 1274B in the second portion 274B of the first gear 274. An example damping grease is one which is commercially available from Nye Lubricants under the product designation 868VH. Hence, the damping grease 178 is provided between the first wall 370A in the second portion 274B of the first gear 274 and the cylindrical member 2273 of the mounting plate 272 and between the second wall 370B in the second portion 274B of the first gear 274 and the cylindrical member 2273 of the mounting plate 272, see FIGS. 2B and 2C. The damping grease may also be provided between an inner wall 1272, see FIG. 2B, of the mounting plate 272 and a side face 2274A of the second portion 274B of the first gear 274, see FIG. 2C. The grease 178 transfers a force via friction from the first gear 274 to the mounting plate 272 in response to rotation of the first gear 274 by the idler gear 236. The drag generating element may comprise an element other than damping grease, such as a protrusion (not shown) extending out from the inner wail 1272 of the mounting plate 272 or a helical spring mounted about the shaft 274C and positioned between the inner wall 1272 of the mounting plate 272 and the second portion 274B of the first gear 274. Alternatively, the damping element may comprise damping grease provided in a recess (not shown) defining by walls within the second gear 275 or the third gear 276 such that the damping grease is provided between the walls defining the recess in the second gear 275 or the third gear 276 and a corresponding cylindrical member 1272C, 1272D forming an integral part of the mounting plate 272 and extending into the corresponding recess in the second gear 275 or the third gear 276. The damping grease may also be provided between a side face of the second gear 275 or the third gear 276 and the inner wall 1272 of the mounting plate 272. It is further contemplated that the damping element may comprising damping grease provided in recesses and/or side faces of two or more of the first, second and third gears 274-276.

In first and second scenarios, the force applied by the first gear 274 to the mounting plate 272 via the damping grease 178 in response to rotation of the first gear 274 causes the mounting plate 272 to pivot. In the first scenario, the swing arm assembly 270 is initially in its first end-most position, as shown in FIG. 7, with a lever 300 positioned in its released position, i.e., spaced from an L-shaped portion 272C of the mounting plate 272. Upon rotation of the idler gear 236 clockwise in FIG. 5 and counter-clockwise in FIG. 2A, the first gear 274 is caused to rotate counter-clockwise in FIG. 7 and clockwise in FIG. 2A such that the damping grease 178 frictionally engages the cylindrical member 2273 and the inner wall 1272 of the mounting plate 272 and generates a force so as to move the mounting plate 272 counter-clockwise in FIG. 7. The mounting plate 272 rotates until the third gear 276 engages a sector gear 282 such that the swing arm assembly 270 is located in its second end-most position, see FIG. 8. Once the swing arm assembly 270 is located in its second end-most position, the damping grease 178 allows any further counter-clockwise rotation of the first gear 274, as viewed in FIG. 8, to occur relative to the mounting plate 272.

In the second scenario, when the swing arm assembly 270 is in its second end-most position, as shown in FIG. 9, and the idler gear 236 rotates counter-clockwise in FIG. 9 and clockwise in FIG. 2A, the first gear 274 is caused to rotate clockwise in FIG. 9 and counter-clockwise in FIG. 2A causing the damping grease 178 to frictionally engage the cylindrical member 2273 and the inner wall 1272 of the mounting plate 272 and generate a force so as to move the mounting plate 272 clockwise in FIG. 9. The mounting plate 272 rotates until the second gear 275 engages the sector gear 282 such that the swing arm assembly 270 is in its first end-most position, see FIG. 4. Once the swing arm assembly 270 is located in its first end-most position, the damping grease 178 allows any further clockwise rotation of the first gear 274, as viewed in FIG. 4, to occur relative to the mounting plate 272.

The cam assembly 280 comprises, in the illustrated embodiment, the sector gear 282, a cam shaft 284 and first and second cam elements 286 and 288, see FIGS. 2, 2A and 3. The sector gear 282 and the first and second cam elements 286 and 288 are mounted to the cam shaft 284 for rotation with the cam shaft 284, see FIG. 3. The sector gear 282 comprises a first segment 282A including teeth 283 and a second segment 282B devoid of teeth, see FIG. 4. The first segment 282A defines a first arc of about 288 degrees, while the second segment 282B defines a second arc of about 72 degrees. The size of the first and second arcs may vary.

A catch comprising the lever 300 is coupled to the backup roll 114, with a damping grease (not shown) provided between the lever 300 and the backup roll 114. The damping grease may be one which is commercially available from Nye Lubricants under the product designation 868VH. As noted above, the ITM belt structure 110 comprises a motor 119 for driving the drive roll 118, which, in turn, drives the ITM belt 112. The backup roll 114 is driven by the ITM belt 112. When the motor 119 is operated in a forward direction, the ITM belt 112 and backup roll 114 move clockwise as viewed in FIGS. 1 and 5.

Figure 5:
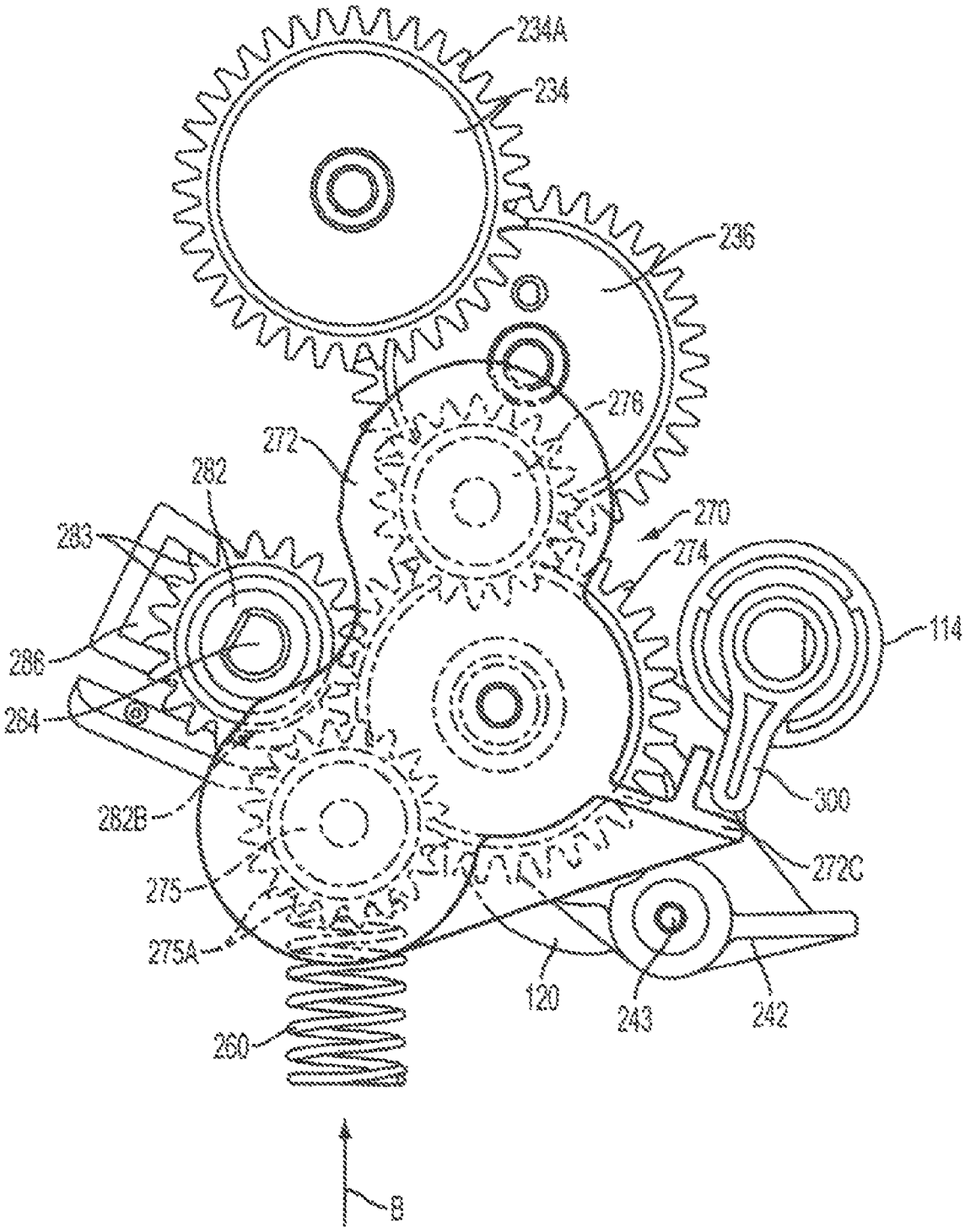
FIG. 5 is a side view of the swing arm assembly in its first end-most position and after a lever has been moved to its locking position and a sector gear has been rotated clockwise from its position shown in FIG. 4.

Prior to pivoting the swing arm assembly 270 from its first end-most position, shown in FIG. 5, to its second end-most position, as shown in FIG. 8, the ITM belt structure motor 119 is caused to move in reverse for a short period of time so as to cause the ITM belt 112 and back up roll 114 to move in reverse, counterclockwise in FIGS. 1 and 5. Reverse movement of the backup roll 114 is frictionally transferred by the damping grease to the lever 300 such that the lever 300 moves counterclockwise in FIG. 5. The motor 119 is operated in the reverse direction until the lever 300 has rotated from its locking position shown in FIG. 5 to its released position shown in FIG. 7. With the lever 300 in its released position shown in FIG. 7, the swing arm assembly 270 may be pivoted from its first end-most position, as shown in FIG. 7, to its second end-most position, as shown in FIG. 8, without the mounting plate 272 engaging the lever 300.

Figure 4:
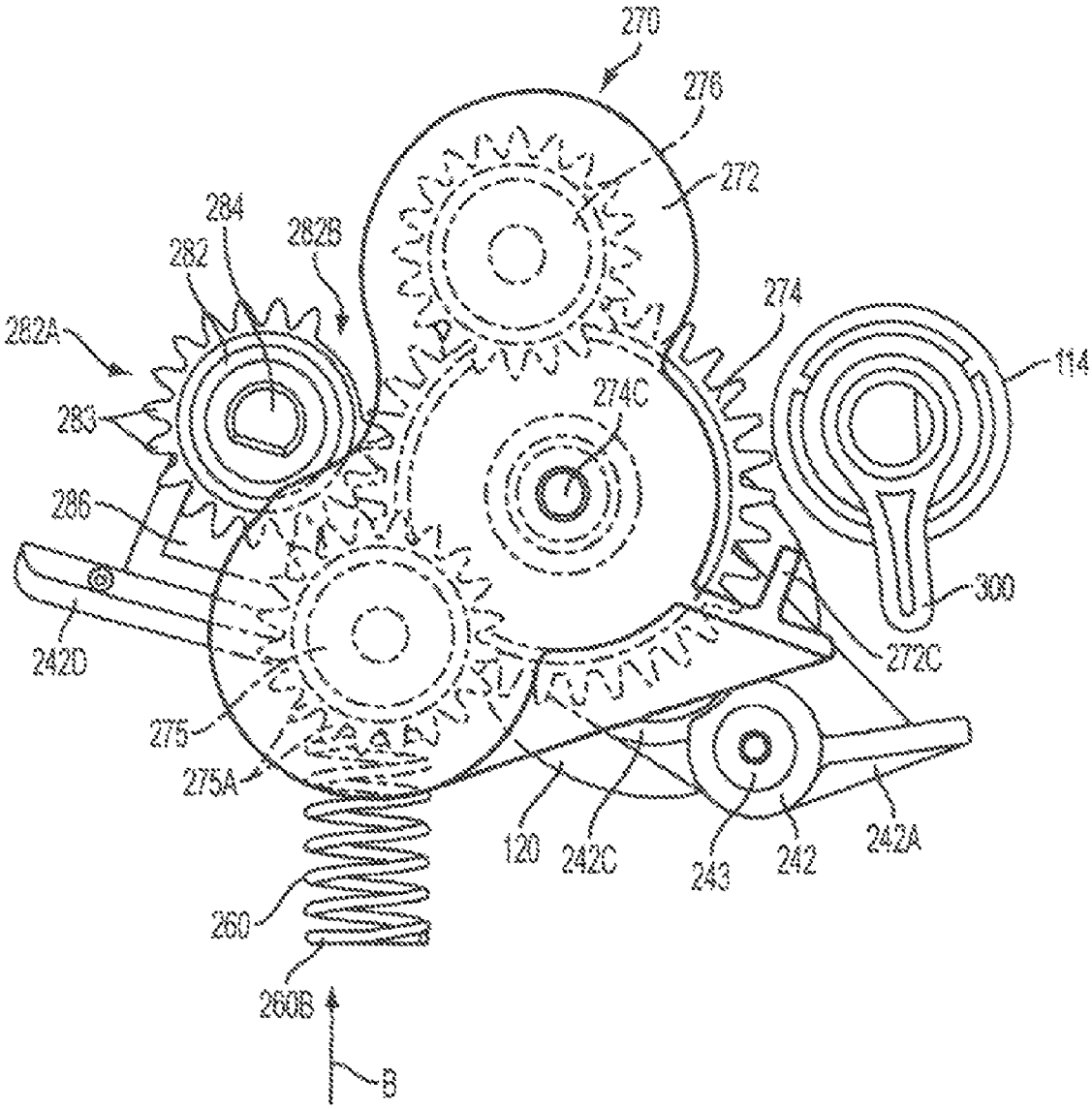
FIG. 4 is a side view of the swing arm assembly lust after the assembly is moved to its first end-most position.

After the swing arm assembly 270 is moved from its second end-most position, as shown in FIG. 9, to its first-end most position, as shown in FIG. 4, the ITM belt structure motor 119 is caused to move in its forward direction, such that the ITM belt 112 and the backup roll 114 move clockwise in FIGS. 1 and 4. Clockwise motion from the backup roll 114 is frictionally transferred to the lever 300 via the damping grease such that the lever 300 rotates clockwise from its released position in FIG. 4 to its locking position in FIG. 5. The lever 300 is in its locking position once it engages the L-shaped portion 272C of the mounting plate 272. Once the lever 300 engages the L-shaped portion 272C of the mounting plate 272 and stops rotating, the damping grease allows the backup roll 114 to rotate relative to the non-moving lever 300.

When the lever 300 is located in its locking position, the lever 300 prevents movement of the swing arm assembly 270 from its first-end most position to its second-end most position. Hence, the motor 222 can be operated in a reverse direction, which reverse movement is required during duplex printing operations, resulting in the first gear 274 rotating counterclockwise in FIG. 5, without risk of the swing arm assembly 270 being moved from its first-end most position to its second-end most position. In the illustrated embodiment, the motor 222 is operated in the reverse direction during a portion of a duplex printing operation to allow the exit rolls 144, which are driven by the motor 222, to rotate in a reverse direction to a feed a substrate into the duplexing path 146. It is preferred that the transfer roll 120 not be moved away from the belt 112 and backup roll 114 during the duplex printing operation because movement of the transfer roll 120 may disturb any toner material on the belt 112 when the transfer roll 120 is moved, thereby causing a print defect.

In the first scenario, the ITM belt structure motor 119 is first caused to move in reverse for a short period of time so as to cause the lever 300 to move counterclockwise from its position shown in FIG. 5 to its position shown in FIG. 7. With the swing arm assembly 270 in its first end-most position and the lever 300 in its released position, as shown in FIG. 7, the meter 222 is caused to move in reverse such that the idler gear 236 rotates clockwise in FIG. 5 and counter-clockwise in FIG. 2A. Clockwise movement of the idler gear 236 in FIG. 5 causes the first gear 274 to rotate counter-clockwise in FIG. 7 and clockwise in FIG. 2A causing the damping grease 178 to frictionally engage the cylindrical member 2273 and the inner wall 1272 of the mounting plate 272 and generate a force so as to move the mounting plate 272 counter-clockwise in FIG. 7. The mounting plate 272 rotates until teeth 276A on the third gear 276 mesh with the teeth 283 on the sector gear 282 such that the swing arm assembly 270 is in its second end-most position, see FIG. 8. Rotation of the first gear 274 counter-clockwise in FIG. 8 and clockwise in FIG. 2A causes the third gear 276 to rotate clockwise in FIG. 8 and counter-clockwise in FIG. 2A. Once the teeth 276A on the third gear 276 engage with the teeth 283 on the sector gear 282, the third gear 276 causes the sector gear 282 to rotate counter-clockwise in FIG. 8 and clockwise in FIG. 2A. Once the sector gear 282 is needy in the position shown in FIG. 9, the first and second cams 286 and 288 are nearly in the position shown in FIGS. 3 and 9 and in an overcenter state. The springs 280, 262, which apply a force in a direction opposite to arrow A in FIGS. 8 and 9, cause the cams 286 and 288 to move to the positions shown in FIGS. 3 and 9, which, in turn, causes the sector gear 282 to move counter-clockwise, as viewed in FIGS. 8 and 9, a small amount to the position illustrated in FIG. 9 such that the teeth 276A on the third gear 276 are no longer in engagement with teeth 283 on the sector gear 282, but, rather, are positioned directly across from the second segment 282B of the sector gear 282, which, as noted above, is devoid of teeth. The sector gear 282 is maintained in the position shown in FIG. 9 by flat surfaces 236A and 288A on the first and second cams 286 and 288 engaging flat surfaces 242F and 244F on the second ends 242D and 244D of the first and second levers 242 and 244, see FIG. 3, until the second gear 275 engages and rotates the sector gear 282.

As the sector gear 282 is rotated from its position shown in FIG. 8 to the position shown in FIG. 9, the first and second cam elements 286 and 288 engage the second ends 242D and 244D of the first and second levers 242 and 244 and apply a downward force generally in the direction of arrow A in FIGS. 8 and 9. Downward movement of the lever second ends 242D and 244D causes the levers 242 and 244 to pivot sway from the backup roller 114 and compress the first and second springs 260 and 262. As the levers 242 and 244 pivot away from the backup roller 114, the transfer roll 120 also pivots away from the backup roll 114 so as to substantially reduce the force/roll contact length applied by the transfer roll 120 to the backup roll 114 and the belt 112. The force/roll contact length may be reduced to any value between 0 g/mm of roll contact length and 36 g/mm of roll contact length.

Just prior to the printer 10 being turned off or after being inactive for an extended period of time, the processor 12 first actuates the ITM belt structure motor 119 to move in reverse for a short period of time so as to cause the lever 300 to move counterclockwise from its position shown in FIG. 5 to its position shown in FIG. 7. The processor 12 then actuates the motor 222 to move in reverse to effect rotation of the first gear 274 counterclockwise in FIG. 7 and clockwise in FIG. 2A such that the first and second cams 286 and 288 are rotated to a position so as to cause the levers 242 and 244 and the transfer roll 120 to pivot away from the backup roll 114. Thus, the pressure applied by the transfer roll 120 to the backup roll 114 is substantially reduced, thereby reducing the likelihood that the polymeric outer layer 120B of the transfer roll 120 will be deformed permanently while the printer 10 is off or inactive.

In the second scenario, noted above, when the swing arm assembly 270 is in its second end-most position, as shown in FIG. 9, and the idler gear 236 rotates counter-clockwise in FIG. 9 and clockwise in FIG. 2A, the first gear 274 is caused to rotate clockwise in FIG. 9 and counter-clockwise in FIG. 2A causing the damping grease 178 to frictionally engage the cylindrical member 2273 and the inner wall 1272 of the mounting plate 272 and generate a force so as to move the mounting plate 272 clockwise in FIG. 9. The mounting plate 272 rotates until teeth 275A on the second gear 275 mesh with the teeth 283 on the sector gear 282 such that the swing arm assembly 270 is in its first end-most position, see FIG. 4. Rotation of the first gear 274 clockwise in FIG. 4 and counter-clockwise in FIG. 2A causes the second gear 275 to rotate counter-clockwise in FIG. 4 and clockwise in FIG. 2A. Once the teeth 275A on the second gear 275 mesh with the teeth 283 on the sector gear 282, the second gear 275 causes the sector gear 282 to rotate clockwise in FIG. 4 and counter-clockwise in FIG. 2A. Once the sector gear 282 is nearly in the position shown in FIG. 5, the first and second cams 286 and 288 are nearly in the position shown in FIGS. 5 and 6 and in an overcenter state. The springs 260, 262, which apply a force in a direction of arrow B in FIGS. 4 and 5, cause the cams 286 and 288 to move to the positions shown in FIGS. 5 and 6, which, in turn, causes the sector gear 282 to move clockwise, as viewed in FIGS. 4 and 5, a small amount to the position illustrated in FIG. 5 such that the teeth 275A on the second gear 275 are no longer in engagement with the teeth 283 on the sector gear 282, but, rather, are positioned directly across from the second segment 282B of the sector gear 282, which, as noted above, is devoid of teeth. The sector gear 282 remains in the position shown in FIG. 5 until the third gear 276 engages and rebates the sector gear 282.

As noted above, after the swing arm assembly 270 is moved from its second end-most position, as shown in FIG. 9, to its first-end most position, as shown in FIG. 4, the ITM belt structure motor 119 is caused to move in its forward direction, such that the lever 300 is moved to its locking position, as shown in FIG. 5.

As the sector gear 282 is rotated from its position shown in FIG. 4 to the position shown in FIG. 6, the first and second cams 286 and 288 are rotated so as to disengage the second ends 242D and 244D of the first and second levers 242 and 244. In response, the springs 260 and 262 expand and apply upward forces onto the first and second levers 242 and 244 generally in the direction of arrow B in FIGS. 4 and 5. The upward forces generated by the expanded springs 260 and 262 against the levers 242 and 244 cause the levers 242 and 244 to pivot about the pins 243 and 245 clockwise in FIGS. 4 and 5 and move toward the backup roller 114. The upward forces from the springs 260 and 262 onto the levers 242 and 244 further cause the levers 242 and 244 to increase the pressure applied by the transfer roll 120 to the belt 112 and backup roll 114. The spring rates of the springs 260 and 262 are preferably selected such that the forces applied by the levers 242 and 244 to the transfer roll 120 are sufficient to achieve a desired nip load, i.e., a desired compressive load within the nip 130.

No sensors are provided to determine the positions of any of the elements of the nip-loading structure 240, the transfer roll 120, the backup roll 114, the first and second springs 260 and 262, the swing arm assembly 270, the cam assembly 280, the drive motor 222 or the speed reduction gear train 230. Hence, the motion transfer structure 210 and the drive apparatus 220 do not comprise a sensor feedback loop.

The ITM belt structure 110, the transfer roll 120 and the gear train 230 except for the first compound gear 232 may define a single replaceable unit in the printer 10.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A toner image transfer apparatus in a printer comprising:

transfer belt structure comprising a driven toner image transfer belt and a rotatable backup roll engaging an inner surface of said transfer belt;

a rotatable transfer roll adapted to define a nip with said belt and backup roll; and a transfer roll retraction mechanism comprising motion transfer structure coupled to said transfer roll and drive apparatus associated with said motion transfer structure and including a drive motor shared with another structure in the printer separate from said motion transfer structure of said transfer roll retraction mechanism, said motion transfer structure applying a sufficient force to said transfer roll to achieve a desired nip load in response to said drive motor rotating in a first direction and said motion transfer structure decreasing said force to said transfer roll to decrease the load at said nip in response to said drive motor rotating in a second direction, wherein said motion transfer structure applying and decreasing said force without the use of a sensor feedback loop;

wherein said drive apparatus further comprises a gear train associated with said drive motor;

wherein said motion transfer structure comprises:

a nip-loading structure for engaging said transfer roll;

at least one bias member for engaging said nip-loading structure;

a first assembly for pivoting to a first position in response to said drive motor rotating in said first direction and to a second position in response to said drive motor rotating in said second direction; and a cam assembly including at least one cam element for positioning said nip-loading structure to apply said sufficient force to said transfer roll in response to said drive motor rotating in said first direction and for positioning said nip-loading structure to decrease the force applied to said transfer roll in response to said drive motor rotating in said second direction;

wherein said first assembly comprises a mounting plate and a gear assembly mounted to said mounting plate, said gear assembly engaging with a gear forming part of said drive apparatus gear train, said mounting plate pivoting in response to movement of said gear assembly, and said first assembly pivoting about an axis of a gear in said gear assembly;

wherein said transfer belt structure further comprises a catch associated with said backup roll for rotating with said backup roll and restraining said mounting plate when moved to a locking position in response to said backup roll rotating in a forward direction, said backup roll rotating in a forward direction in response to said transfer belt moving in a forward direction.

2. The toner image transfer apparatus as set out in claim 1, wherein said first assembly comprises a swing arm assembly and said gear assembly comprises:

a first gear mounted to said mounting plate adapted to engage with said gear forming part of said drive apparatus gear train, said swing arm assembly pivoting about an axis of said first gear;

second and third gears mounted to said mounting plate and in engagement with said first gear for rotation with said first gear; and a drag generating element provided between said mounting plate and at least one of said first, second and third gears, said drag generating element transferring a force via friction from said one gear to said mounting plate in response to rotation of said one gear, said force causing said mounting plate to pivot in response to movement of said at least one gear and said drag generating element allowing said at least one gear to rotate relative to said mounting plate once said mounting plate has pivoted in response to movement of said at least one gear.

3. The toner image transfer apparatus as set out in claim 2, wherein said cam assembly comprises:

a sector gear comprising a first segment including teeth and a second segment devoid of teeth;

a cam shaft coupled to said sector gear for rotation with said sector gear; and a first cam element coupled to said cam shaft for rotation with said cam shaft, wherein said second gear causing said sector gear to rotate to effect movement of said cam shaft to cause said first cam element to position said nip-loading structure to apply said sufficient force to said transfer roll and said third gear causing said sector gear to rotate to cause said first cam element to position said nip-loading structure to decrease the force applied to said transfer roll.

4. The toner image transfer apparatus as set out in claim 3, wherein said cam assembly further comprises a second cam element.

5. The toner image transfer apparatus as set out in claim 4, wherein said nip-loading structure comprises:

a first lever pivotably coupled at a first end to a frame and comprising an intermediate portion to which said transfer roll is coupled and a second end for engaging said first cam element; and a second lever pivotably coupled at a first end to the frame and comprising an intermediate portion to which said transfer roll is coupled and a second end for engaging said second cam element.

6. The toner image transfer apparatus as set out in claim 5, wherein said at least one bias member comprises first and second springs, said first spring extending between the frame and said first lever and said second spring extending between the frame and said second lever.

7. The toner image transfer apparatus as set out in claim 2, wherein said drag generating element comprises a damping grease.

8. The toner image transfer apparatus as set out in claim 1, wherein said transfer belt causes said backup roll to rotate in a reverse direction when said belt moves in a reverse direction, and said backup roll causing said catch to move from the locking position to a released position when said backup roll rotates in the reverse direction.

9. The toner image transfer apparatus as set out in claim 8, wherein movement of said backup roll is transferred to said catch via damping grease.

10. A toner image transfer apparatus in a printer comprising:

transfer belt structure comprising a driven toner image transfer belt and a rotatable backup roll engaging an inner surface of said transfer belt;

a rotatable transfer roll adapted to define a nip with said belt and backup roll; and a transfer roll retraction mechanism comprising motion transfer structure coupled to said transfer roll and drive apparatus associated with said motion transfer structure and including a drive motor, said motion transfer structure applying a sufficient force to said transfer roll to achieve a desired nip load in response to said drive motor rotating in a first direction and said motion transfer structure decreasing said force to said transfer roll to decrease the load at said nip in response to said drive motor rotating in a second direction, wherein said motion transfer structure applying and decreasing said force without the use of a sensor feedback loop;

wherein said motion transfer structure comprises:

nip-loading structure for engaging said transfer roll;

at least one bias member for engaging said nip-loading structure;

a swing arm assembly adapted to pivot to a first position in response to said drive motor rotating in said first direction and to a second position in response to said drive motor rotating in said second direction; and a cam assembly including at least one cam element for positioning said nip-loading structure to apply said sufficient force to said transfer roll in response to said drive motor rotating in said first direction and for positioning said nip-loading structure to decrease the force applied to said transfer roll in response to said drive motor rotating in said second direction;

wherein said drive apparatus further comprises a gear train associated with said drive motor;

wherein said swing arm assembly comprises a mounting plate and a gear assembly mounted to said mounting plate, said gear assembly engaging with a gear forming part of said drive apparatus gear train, said mounting plate pivoting in response to movement of said gear assembly, and said swing arm assembly pivoting about an axis of a gear in said gear assembly;

wherein said transfer belt structure further comprises a catch associated with said backup roll for rotating with said backup roll and restraining said mounting plate when moved to a locking position in response to said backup roll rotating in a forward direction, said backup roll rotating in a forward direction in response to said transfer belt moving in a forward direction.

11. The toner image transfer apparatus as set out in claim 10, wherein said gear assembly of said_swing arm assembly comprises:

a first gear mounted to said mounting plate adapted to engage with said gear forming part of said drive apparatus gear train, said swing arm assembly pivoting about an axis of said first gear;

second and third gears mounted to said mounting plate and in engagement with said first gear for rotation with said first gear; and a drag generating element provided between said mounting plate and at least one of said first, second and third gears, said drag generating element transferring a force via friction from said one gear to said mounting plate in response to rotation of said one gear, said force causing said mounting plate to pivot in response to movement of said one gear.

12. The toner image transfer apparatus as set out in claim 11, wherein said cam assembly comprises:

a sector gear comprising a first segment including teeth and a second segment devoid of teeth;

a cam shaft coupled to said sector gear for rotation with said sector gear; and a first cam element coupled to said cam shaft for rotation with said cam shaft, wherein said second gear causing said sector gear to rotate to effect movement of said cam shaft to cause said first cam element to position said nip-loading structure to apply said sufficient force to said transfer roll and said third gear causing said sector gear to rotate to cause said first cam element to position said nip-loading structure to decrease the force applied to said transfer roll.

13. The toner image transfer apparatus as set out in claim 12, wherein said cam assembly further comprises a second cam element.

14. The toner image transfer apparatus as set out in claim 13, wherein said nip-loading structure comprises:

a first lever pivotably coupled at a first end to a frame and comprising an intermediate portion to which said transfer roll is coupled and a second end for engaging said first cam element; and a second lever pivotably coupled at a first end to the frame and comprising an intermediate portion to which said transfer roll is coupled and a second end for engaging said second cam element.

15. The toner image transfer apparatus as set out in claim 14, wherein said at least one bias member_comprises first and second springs, said first spring extending between the frame and said first lever and said second spring extending between the frame and said second lever.

16. The toner image transfer apparatus as set out in claim 11, wherein said drag generating element comprises a damping grease.

17. The toner image transfer apparatus as set out in claim 10, wherein said transfer belt causes said backup roll to rotate in a reverse direction when said belt moves in a reverse direction, and said backup roll causing said catch to move from the locking position to a released position when said backup roll rotates in the reverse direction.

18. The toner image transfer apparatus as set out in claim 17, wherein movement of said backup roll is transferred to said catch via damping grease.

19. A transfer belt structure comprising:

a driven toner image transfer belt;

a rotatable element engaging a surface of said transfer belt; and a catch associated with said rotatable element and for rotating with said rotatable element and restraining a mounting plate when moved to a locking position in response to said rotatable element rotating in a forward direction, said rotatable element rotating in a forward direction in response to said transfer belt moving in a forward direction;

wherein said transfer belt causes said rotatable element to rotate in a reverse direction when said belt moves in a reverse direction, and said rotatable element causing said catch to move from the locking position to a released position when said rotatable element rotates in the reverse direction.

20. The transfer belt structure as set out in claim 19, wherein said rotatable element comprises a rotatable backup roll engaging said surface of said transfer belt, and said backup roll defining a nip with said belt and a rotatable transfer roll.

21. A transfer belt structure comprising:

a driven toner image transfer belt;

a rotatable element engaging a surface of said transfer belt; and a catch associated with said rotatable element for rotating with said rotatable element and restraining a mounting plate when moved to a locking position in response to said rotatable element rotating in a forward direction, said rotatable element rotating in a forward direction in response to said transfer belt moving in a forward direction, wherein movement of said rotatable element is transferred to said catch via damping grease.

* * * * *